US005510044A

United States Patent [19]

Laskowski et al.

[11] Patent Number: 5,510,044

[45] Date of Patent: Apr. 23, 1996

[54] COMPOSITION FOR FROTH FLOTATION OF MINERAL ORES COMPRISING AMINE AND FROTHER

[75] Inventors: Janusz S. Laskowski, Richmond; Qun Wang; Elena A. Alonso, both of Vancouver, Canada

[73] Assignee: The University of British Columbia, Vancouver, Canada

[21] Appl. No.: 249,407

[22] Filed: May 26, 1994

[51] Int. Cl.[6] ..... B03D 1/018

[52] U.S. Cl. ..... 252/61; 209/166

[58] Field of Search ..... 209/166, 167; 252/61

[56] References Cited

U.S. PATENT DOCUMENTS

| | | | |
|---|---|---|---|
| 2,460,259 | 1/1949 | Kahler . | |
| 2,649,415 | 8/1953 | Sundberg et al. . | |
| 2,689,649 | 9/1954 | Atwood . | |
| 2,721,657 | 10/1955 | Smith . | |
| 2,816,870 | 12/1957 | Lentz et al. | 252/61 |
| 2,937,751 | 5/1960 | Schoeld . | |
| 2,956,889 | 10/1960 | Denman . | |
| 3,029,125 | 4/1962 | Hummel . | |
| 3,310,170 | 3/1967 | Abernathy . | |
| 3,378,581 | 4/1968 | Hummel . | |
| 3,418,253 | 12/1968 | Silverstein et al. . | |
| 3,975,295 | 8/1976 | Koch . | |
| 4,325,821 | 4/1982 | Escalera . | |
| 4,394,257 | 7/1983 | Wang et al. . | |
| 4,532,031 | 7/1985 | Wang et al. . | |
| 4,908,125 | 3/1990 | MacKenzie et al. | 209/166 |
| 4,995,998 | 2/1991 | von Rybinski et al. | 252/61 |
| 5,122,289 | 6/1992 | MacKenzie et al. | 252/61 |

FOREIGN PATENT DOCUMENTS

| | | |
|---|---|---|
| 1038860 | 8/1966 | United Kingdom . |

*Primary Examiner*—Thomas M. Lithgow
*Attorney, Agent, or Firm*—Richard P. Fennelly; Louis A. Morris

[57] ABSTRACT

A composition, adapted to be used in the flotation of ore fractions in aqueous suspension, with the advantages of better dispersability of the amine and improved flotation results. The composition consists essentially of: (a) water; (b) a long chain aliphatic amine; and (c) a frother. The composition may further contain a carboxylic or mineral acid emulsifier.

17 Claims, No Drawings

COMPOSITION FOR FROTH FLOTATION OF MINERAL ORES COMPRISING AMINE AND FROTHER

BACKGROUND OF THE INVENTION

Potassium along with phosphorous and nitrogen are major plant growth nutrients. As a commercial source of potassium, potash ores form the basis for the manufacture of fertilizers for the agriculture industry. The most important potash ore, sylvinite, contains sylvite (KCl) and halite (NaCl), and these two minerals are commonly separated by flotation carried out in saturated brine. Primary long-chain amines are exclusively utilized to float sylvite from halite.

Sylvinites may contain up to 15% of insoluble gangue minerals (anhydrite, dolomite, clays, etc.), which must be removed prior to floating sylvite either by mechanical means, or by selective flocculation-flotation. Desliming is followed by sylvite/halite differential flotation commonly preceded by classification of the ore into coarse and fine streams which are conditioned separately with the flotation reagents. In the case of flotation of fines, the reagents include long-chain amine collector and frother; in the case of coarse fractions flotation, an extender oil is utilized along with long-chain amines and a frother. In commercial practice, widely adopted ESSO 904 brand oil is used as an extender oil; frothers are added to the pulp last, just before flotation following conditioning with all reagents.

The solubility of long-chain aliphatic amines in water is very low and further decreases in brine. Since the Krafft points for long-chain amines in brine significantly exceed temperatures at which commercial potash flotation plants operate (10°–35° C.), such amines in brine appear in the form of colloidal species (J. S. Laskowski, Flotation of Potash Ores, *SME Symposium Reagents for Better Metallurgy,* Albuquerque, February, 1994). The evidence advanced by several researches (J. Leja, in *Potash Technology,* Pergamon Press, Toronto, 1983, pp. 623–629) suggests that such colloidal species are responsible for the flotation of sylvite particles. Colloidal dissolution of amines is clearly affected by surfactants such as alcohols (A. W. Ralston & C. W. Hoerr, *J. Am. Chem. Soc.*, vol. 68, pp. 851–854, 1946; H. M. Alexandrovich et al., in *Flotation Reagents,* Nauka, Moscow, 1986, pp. 170–176). According to J. Leja, the rate of spreading of amine films at the air/liquid interface, very low in brine, sharply increases in the presence of alcohols.

Aliphatic amines are also used as metal corrosion inhibitors (U.S. Pat. No. 2,460,259). Since long-chain amines are nearly insoluble in water, the deposition of a protective film of a corrosion inhibiting substance, such as octadecylamine, confronted a number of problems. The use of dispersing/emulsifying aids to prepare corrosion inhibitor dispersions was found to be beneficial. Examples of several patented additives have been listed below: polyalkoxylated derivatives of monocarboxylic acids and alkyl phenols (U.S. Pat. No. 2,649,415), condensates of aliphatic amines with ethylene oxide (U.S. Pat. Nos. 2,956,889 and 3,418,253) and other amine derivatives (U.S. Pat. Nos. 3,029,125, 3,378,581 and 3,860,430).

In order to increase fatty amine dispersability in water, it has been suggested in U.S. Pat. No. 2,816,870 to dissolve the fatty amine in an alkoxyalkanol solvent and use either a cationic or non-ionic dispersing agent. Another patent (British Patent No. 1,038,860) suggests the use of quaternary ammonium salt emulsifiers to enhance the dispersability of fatty amines in water.

SUMMARY OF THE INVENTION

The present invention relates to improving the flotation of mineral ores by utilizing a composition consisting essentially of: (a) water; (b) a long chain aliphatic amine; and (c) a frother. Optionally, a carboxylic or mineral acid may be used as an emulsifier.

DESCRIPTION OF PREFERRED EMBODIMENTS

In its broadest embodiment, the composition described herein which is useful in the flotation of ore fractions, such as potash ore, consists essentially of:

(a) water;

(b) long chain aliphatic amine; and (c) frother. Optionally, a carboxylic or mineral acid emulsifier can also be present. Generally speaking, operative amounts for the amine, frother and acid emulsifier (if present) will fall within the following weight amounts: amine: from about 0.1% to about 10%, by weight of the total formulation; frother: from about 0.1% to about 30%, by weight of the total formulation; and emulsifier (if present): from about 0.1% to about 10%, by weight of the total formulation.

The long chain aliphatic amine which forms one essential component of the present invention can be selected from known amine collectors known to persons of ordinary skill in the art of ore flotation. Generally speaking, such amines can be alkyl primary amines of the formula $RNH_2$, where R is a $C_8$ to $C_{22}$ alkyl group and/or an alkyl secondary amine of the formula $(R_1)(R_2)NH$, with $R_1$ and $R_2$ being independently an alkyl group such as previously defined for $R_1$ above. In regard to either type of amine, their water soluble salts, such as the acetate or chloride, may also be employed.

The frother which is suitable for use herein can also be any of the frothers known to persons of ordinary skill in the art of ore flotation with the alcohol and polyglycolether types being preferred for use. Some particularly preferred frothers include the following:

(a) methyl isobutyl carbinol of the formula

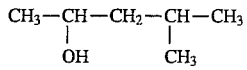

known in the trade as "MIBC", and obtainable at 97.5% purity from Shell SA (Pty) Ltd.;

(b) polypropylene glycol produced and marketed by Dow Chemical Africa (Pty) Ltd. under the trade name "DOWFROTH 200". DOWFROTH 200 is a polypropylene glycol ether of the following formula:

$$CH_3—(O—C_3H_6)_x—OH$$

and has an average molecular weight of 200; and (c) tri-ethoxy-butane known in the trade as "TEB", and obtainable from Sentrachem Ltd., South Africa.

A most preferred frother for the composition according to the invention is MIBC.

In addition to the essential amine and frother components which have been previously described, an optional additive is an acid emulsifier for the amine. Either carboxylic acid or mineral acid emulsifiers can be used with acetic acid and hydrochloric acid being particularly preferred.

The present invention is illustrated by the Examples which follow.

EXAMPLE 1

This Example illustrates the ore flotation effects depending upon when the frother is present during the ore flotation process in the flotation column. The observed reduced viscosity of amine solutions in the presence of the frother indicates that frothers improve colloidal dissolution of amine in brine.

In two tests, part of the frother, MIBC (methyl isobutyl carbinol which is also called "methyl amyl alcohol") was premixed with the amine aqueous solution and this combined solution was added to the slurry at the conditioning stage (three minutes) with the rest of the MIBC being added to the flotation column. In both tests, the amine was hydrogenated tallowalkylamine (ARMEEN HTD brand from Akzo Chemicals Inc.) and was added at a dosage of 50 gm/ton of ore with the MIBC being present in a total amount of 167 gm/ton. When 20 gm/ton of MIBC was premixed with the previously mentioned amount of amine, the flotation recovery of coarse (–3.5+18 mesh, –5.6+1.0 mm) potash fractions was 70.7%, and when 50 gm/ton of MIBC was premixed the recovery was 77.7%. In both cases the recovery exceeds 70%.

In four additional tests, MIBC and amine aqueous solutions were added separately, but at the same time, into the slurry containing the ore at the conditioning stage (three minutes). All of the previously described premixed compositions, when the constituents of the premix were thus added separately, gave the same flotation value of 51.4% The use of a significantly more concentrated composition of 200 gm/ton of the same amine and 416 gm/ton of MIBC produced a recovery of 82.1%. The use of a 200 gm/ton amine-167 gm/ton MIBC combination gave a recovery of 39.0%.

Trials were also conducted in which the MIBC was added into the slurry at the last minute of the conditioning stage following a two minute period of conditioning with the pulp containing the coarse potash particles. When this procedure was used with both the previously described 200 gm/ton amine- 416 gm/ton MIBC and 50 gm/ton amine-167 gm/ton MIBC compositions, the recovery fell to 46.1% and 46.6% respectively. The recovery for the 200 gm/ton amine-167 gm/ton MIBC composition fell to 37.7%.

Finally, the 200 gm/ton amine-167 gm/ton MIBC combination was used separately in a flotation test in which the coarse potash particles were conditioned for three minutes with the amine with the MIBC being added directly into the flotation column. The recovery was only 7.4%.

The test conditions and the results are summarized in Table 1.

TABLE 1

| Test | 1 | 2 | 3 | 3' |
|---|---|---|---|---|
| Armeen HTD (aq), g/t | 200 | 200 | 50 | 50 |
| MIBC dosage, g/t | 167 | 419 | 167 | 167 |
| MIBC in amine (aq)*, g/t | | | 20 | 50 |
| MIBC addition point** | | Flotation recovery, % | | |
| In | | | 70.7 | 77.7 |
| Co | 39.0 | 82.1 | 51.4 | 51.4 |
| After | 37.7 | 46.1 | 46.6 | |
| Column | 7.4 | | | |

*When applicable.

TABLE 1-continued

| Test | 1 | 2 | 3 | 3' |
|---|---|---|---|---|

**In: part of MIBC premixed with amine aqueous solution in accordance with the invention, Co: MIBC and amine solution added to conditioning at the same time but separately, After: MIBC added to conditioning following 2-min conditioning with amine solution, Column: MIBC added directly to the flotation column.

EXAMPLE 2

This Example illustrates the effect of the MIBC addition point on the flotation of fine potash fractions (–0.8 mm), using 100 gm/ton of amine (as in Example 1) and 100 gm/ton of MIBC, in a conventional batch flotation cell.

When the amine and MIBC were prepared as a combined, premixed aqueous solution during amine neutralization and added into the slurry containing the ore at the conditioning stage (three minutes) it was observed that the grade was 76.6% KCl and the KCl recovery was 78.9%.

If the amine and MIBC were premixed and added as a single solution into the slurry at the conditioning stage (three minutes) the grade and recovery were 68.7% and 81.1%, respectively.

The separate addition of amine and MIBC, at the same time, into the slurry at the conditioning stage gave lower grade and recovery values of 56.9% and 52.9%, respectively.

If MIBC was added into the slurry at the last minute of the conditioning stage following a two minute conditioning with the amine collector, the grade and recovery values were 53.8% and 51.7%, respectively.

Finally, If the potash particles were conditioned for three minutes with the amine collector only, and the MIBC was added to the flotation cell thereafter, the values were 50.5% and 52.5%, respectively.

These runs demonstrate that the flotation results were always better when MIBC and amine were mixed and added together to the flotation system.

The foregoing Examples are presented for illustrative purposes only. The scope of protection is set forth in the Claims which follow.

We claim:

1. An emulsified flotation composition, adapted to be used in the flotation of ore fractions in aqueous suspension, which consists essentially of: (a) water; (b) a long chain aliphatic amine present in an amount of from about 0.1% to about 10% by weight of the entire composition; (c) a frother present in an amount of from about 0.1% to about 30% by weight of the entire composition; and (d) an acid emulsifier present in an amount of from about 0.1% to about 10% by weight of the entire composition.

2. A composition as claimed in claim 1 wherein the frother is an alcohol.

3. A composition as claimed in claim 1 wherein the frother is methyl amyl alcohol.

4. A composition as claimed in claim 1 wherein the frother is a polyglycolether.

5. A composition as claimed in claim 1 wherein the amine comprises an aliphatic group of from about eight to about twenty-two carbon atoms.

6. A composition as claimed in claim 2 wherein the amine comprises an aliphatic group of from about eight to about twenty-two carbon atoms.

7. A composition as claimed in claim 3 wherein the amine comprises an aliphatic group of from about eight to about twenty-two carbon atoms.

8. A composition as claimed in claim 4 wherein the amine comprises an aliphatic group of from about eight to about twenty-two carbon atoms.

9. A composition as claimed in claim 1 wherein the acid is a carboxylic acid.

10. A composition as claimed in claim 9 wherein the acid is acetic acid.

11. A composition as claimed in claim 1 wherein the acid is a mineral acid.

12. A composition as claimed in claim 11 wherein the acid is hydrochloric acid.

13. A composition as claimed in claim 1 wherein the amine comprises an aliphatic group of from about eight to about twenty-two carbon atoms and the frother is selected from the group consisting of an alcohol and a polyglycol ether.

14. A composition as claimed in claim 13 wherein the frother is methyl amyl alcohol.

15. A composition as claimed in claim 13 wherein the acid is a carboxylic acid.

16. A composition as claimed in claim 13 wherein the acid is a mineral acid.

17. A composition as claimed in claim 13 wherein the acid is selected from the group consisting of acetic acid and hydrochloric acid.

* * * * *